United States Patent [19]

Arnold

[11] Patent Number: 4,497,444

[45] Date of Patent: Feb. 5, 1985

[54] SHOWER HEAD

[75] Inventor: Don C. Arnold, Buffalo Grove, Ill.

[73] Assignee: Beatrice Foods Company, Chicago, Ill.

[21] Appl. No.: 437,509

[22] Filed: Oct. 28, 1982

[51] Int. Cl.[3] ..... B05B 15/08; B05B 1/30

[52] U.S. Cl. ..... 239/587; 239/569

[58] Field of Search ..... 239/587, 472, 569; 285/263

[56] References Cited

U.S. PATENT DOCUMENTS

| | | | |
|---|---|---|---|
| 713,852 | 11/1902 | Chapin . | |
| 1,363,703 | 12/1920 | Zimmermann . | |
| 1,508,281 | 3/1920 | Kelly . | |
| 1,597,477 | 7/1924 | Panhorst . | |
| 1,714,563 | 5/1929 | Kiel | 285/263 |
| 1,977,241 | 3/1933 | Parker . | |
| 1,984,144 | 12/1934 | Laugaudin . | |
| 2,110,409 | 5/1937 | Veach et al. . | |
| 2,308,476 | 1/1943 | Gerrer . | |
| 2,323,001 | 6/1939 | Bargeboer . | |
| 2,428,748 | 6/1944 | Barz . | |
| 2,465,373 | 3/1949 | Hall . | |
| 2,569,081 | 1/1949 | Veach . | |
| 2,605,019 | 7/1952 | Cornelius | 239/472 X |
| 2,814,526 | 11/1957 | Blair . | |
| 3,210,013 | 10/1965 | Symmons | 239/587 X |
| 3,314,697 | 3/1967 | Freeman . | |
| 3,357,723 | 6/1965 | Dumart et al. . | |
| 3,451,698 | 6/1969 | Chakroff . | |
| 3,454,229 | 7/1969 | Armond | 239/587 X |
| 3,582,114 | 6/1971 | Anderson . | |
| 3,759,550 | 9/1973 | Peress . | |
| 3,799,586 | 3/1974 | Caras et al. . | |
| 3,848,899 | 11/1974 | Smith . | |
| 4,011,996 | 3/1977 | Tsugi et al. . | |
| 4,088,348 | 5/1978 | Shemto . | |

FOREIGN PATENT DOCUMENTS

| | | | |
|---|---|---|---|
| 1332902 | 10/1973 | United Kingdom | 285/263 |

*Primary Examiner*—John J. Love
*Assistant Examiner*—Kevin P. Weldon
*Attorney, Agent, or Firm*—Cook, Wetzel & Egan, Ltd.

[57] ABSTRACT

A shower head is disclosed of the type having a pivotally mounted spray head. The shower head comprises a first member adapted for attachment to a water supply pipe and a spray head pivotally mounted to the first member. The first member includes a concave, socket-defining surface with a water supply aperture therein. The spray head has an inner spray body, through which the water flows, and an outer retaining sleeve, which secures the spray body to the first member. To prevent leakage between the spray body and the sleeve, an annular seal is carried by the spray body and slidably engages the concave surface of the first member along a line which encloses the water supply aperture at all pivot positions of the spray head. In the preferred embodiment, the inlet end of the spray body defines a flow-limiting vortex chamber, into which water is directed in a swirling action. As presently understood, the swirling action creates a centrifugal action away from the center outlet of the vortex chamber, which limits the volume of water flowing through the spray body.

13 Claims, 4 Drawing Figures

SHOWER HEAD

The present invention relates, in general, to domestic shower bath heads and, more particularly, to domestic shower bath heads of the type having a pivotally mounted spray discharge.

Shower bath heads, hereinafter referred to simply as "shower heads", have long been available in a wide variety of shapes and configurations, and with features such as on-off controls, pulsating spray selection, fine-course spray adjustment or various combinations of these and other features. Although sometimes mounted on hand-held spray units, most shower heads are still designed for attachment to a fixed water supply pipe. The latter have typically employed a pivotally adjustable spray head for directing the spray as desired. Although these shower heads work satisfactorily in general, historically they have had a number of drawbacks which have been the subject of continued development and design efforts. For example, pivotally mounted shower heads have typically relied on compression of mating parts alone for sealing. Such shower heads, particularly those employing a plastic ball, often tend to develop leaks at the pivot joint. Other such shower heads have also been relatively complicated or employ numerous parts, which increases the manufacturing costs. In addition, shower heads have sometimes been made of materials which are subject to corrosion, or have employed tiny orifices which tend to clog from mineral deposits, corrosion and the like.

More recently, with increased emphasis on energy conservation, it has also become desirable to provide shower heads with built-in, flow-limiting features to limit the amount of water used. In fact, some governmental bodies have promulgated regulations or ordinances limiting the flow rates of domestic shower heads. This presents a design difficulty in that such a shower head must provide an adequate but not excessive flow over the wide range of water pressures which are found nationwide.

Accordingly, it is a general object of the present invention to provide an improved shower head with a pivotally mounted spray discharge which does not suffer from the drawbacks associated with earlier shower heads of that type.

It is a more particular object of the present invention to provide such an improved shower head which minimizes leakage at the pivot point.

It is a further object of the present invention to provide a shower head which has minimum total parts and may be made of low cost and non-corrosive plastic construction.

It is a still further object of the present invention to provide a shower head with a built-in flow controller to limit water flow to a preferred range, even under differing water pressure conditions.

These and other objects are achieved in the present invention, which is embodied in a shower head that has a first member or portion attachable to a water supply pipe, and a spray head, which comprises an inner spray body, through which water flows, and an outer retaining sleeve, pivotally attached to the first member. In accordance with the present invention, the first member has a concave, socket-defining surface with a water supply aperture therein. The water inlet end of the spray body is pivotally received within the concave, socket-defining surface of the first member or portion.

The water inlet end of the spray body is pivotally received within the concave, socket-defining surface of the first member, and carries annular sealing means which slidably and sealingly engages the concave surface along a line enclosing the water supply aperture at all pivot positions of the spray head. Thus, the water inlet to the spray body is in continuous communication with the water supply aperture in the concave surface regardless of the spray direction, while the annular sealing means prevents leakage between the concave surface and the spray body. Preferably, the annular sealing means is a resilient O-ring which is disposed with a substantial portion of its surface exposed to upstream water pressure. When the shower is turned on, the water pressure acts to stretch the O-ring, forcing the O-ring into closer and tighter sealing contact with the concave surface.

In addition, for limiting the water flow rate, the inlet end of the spray body preferably defines a vortex chamber into which water is directed in a swirling action. The mechanism by which the vortex chamber limits the flow rate is not fully understood. It is presently believed, however, that the swirling water creates a vortex with a resultant centrifugal action away from the center of the chamber. The accompanying pressure drop between the vortex chamber inlet and center outlet serves to limit the flow therethrough. Also, the vortex chamber is, in a sense, self-adjusting to various water pressures, and limits the flow to a preferred range even under different domestic water pressure conditions which exist nationwide. In operation, it is believed that as water supply pressure increases, the centrifugal action increases, counteracting the supply pressure increase and limiting the flow rate to a suitable range. This shower head also may be of relatively low cost plastic construction, requires no moving parts, does not use tiny, spray-creating orifices and, accordingly, is not as susceptible to clogging as earlier shower heads.

These and other objects and advantages of the present invention are set forth in the following description of the preferred embodiment of the present invention which is depicted in the attached drawings, and of which:

Figures 1, 2, 3, 4:
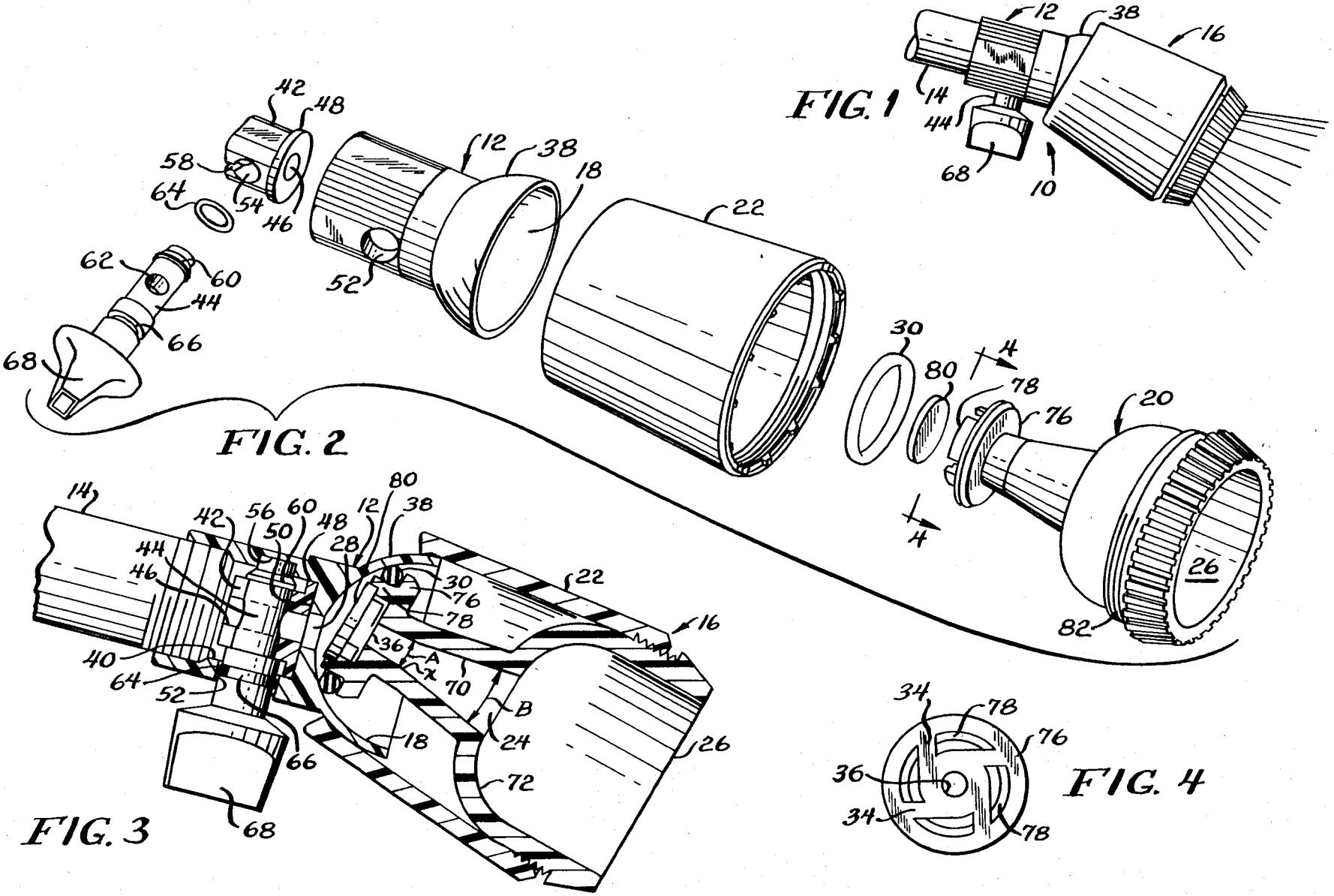
FIG. 1 is a side elevational view of a shower head embodying the present invention attached to a fixed water supply pipe.
FIG. 2 is an exploded view of the shower head of FIG. 1.
FIG. 3 is a vertical sectional view of the shower head of FIG. 1.
FIG. 4 is an end view of the shower head spray body, taken along line 4—4 of FIG. 2.

In general, the present invention is embodied in a shower head, generally at 10, of the type having a fixed portion or member 12 adapted for rigid attachment to a water supply conduit or pipe 14, and a spray head 16 pivotally attached to the fixed member. In accordance with the present invention, (FIGS. 2 and 3) the fixed member 12 has concave, or cup-shaping, socket-defining surface 18 for pivotal attachment of the spray head 16. The pivotal spray head 16 includes an inner spray body 20 and an outer sleeve 22 which holds the spray body in pivotal contact with the socket-defining, concave surface 18. The spray body 20 has a fluid flow path, generally designated 24, extending therethrough, and terminating in a spray outlet 26. Water enters the spray body from a water supply aperture 28 in the concave surface, which communicates with the supply pipe 14.

Sealing means in the form of a resilient O-ring 30 is carried on the inlet end of the spray body and provides a seal between the spray body and the concave socket surface 18 along a generally circular line enclosing the aperture 28 at all pivot positions, thereby permitting pivoting of the spray body while preventing leakage into the area between the spray body and the outer sleeve 22. Because a large portion of the frontal surface of the O-ring is exposed to upstream water pressure, water pressure aids in forcing the O-ring outwardly, into close sealing contact with the concave socket surface 18.

A vortex chamber 32 defined at the inlet end of the spray body limits water flow through the shower head. Water enters the vortex chamber through tangential passageways 34 (FIG. 4), creating a swirling action which is believed to be the reason for the flow-limiting aspect of the vortex chamber. In fact, the greater the water supply pressure, the greater vortex chamber tends to limit the water flow, thus being, in a manner, self-adjustable to a preferred range even under varying water pressure conditions.

Turning now to a more detailed description of the preferred embodiment of the present invention. Fixed member 12 preferably is made of rigid plastic of sufficient strength to withstand typical domestic water pressure. One end of the fixed member is internally threaded for attachment to a typical water supply pipe 14. A shallow, spherically curved wall or shell 38 at the other end of the fixed member forms the concave, socket-defining surface 18. Cylindrical bore 40 extends through the fixed member to permit water flow between the pipe 14 and aperture 28 in the center of the curved wall 38.

Manual control of the water flow rate through the shower head is provided by a plastic valve assembly mounted in the fixed member. The valve assembly comprises an insert 42 received in the bore of the fixed member, and a rotary valve stem 44 which controls flow through the insert. The insert is generally cylindrical, with an axial passageway 46 aligned with outlet aperture 28 for the flow of water, and an end flange 48 which rests against annular shoulder 50 at the end of bore 40 in the fixed member. The insert flange 48 is approximately the same diameter as the bore 40, so that water flowing through the fixed member must pass throught the axial passageway 46 of the insert.

Water flow through passageway 46 is regulated by the valve stem 44, which extends at a right angle through the insert. As best seen in FIGS. 2 and 3, the valve stem 44 extends through a valve stem opening 52 in the fixed member, through the apertures 54 in side wall of the insert and terminates in a shallow recess 56 in the opposite side wall of the fixed member. A slit 58 between apertures 54 and the end of the insert permits temporary enlargement of apertures for insertion of the valve stem. Tapered detent 60 on the end of the valve stem is of larger diameter than apertures 54 to prevent withdrawal of the stem. Flow is controlled by controlling the degree by which valve stem bore 62 is aligned with the insert passageway 46. An O-ring 64 in annular groove 66 in the valve stem provides a water-tight seal between the valve stem and the valve stem opening 52 in the fixed member. A thumb knob 68 on the exterior end of the valve stem permits rotation of the valve stem to select an infinite range of flow rates between a full flow condition, when valve stem bore 62 is aligned with axial passageway 46 and a completely blocked flow condition when the bore 62 is substantially at right angles to the passageway.

Water exiting from the center outlet aperture 28 of the fixed member 12 enters the inlet end of the pivotally mounted spray body 20. As with the fixed member 12, the spray body 20 is preferably molded from rigid plastic. The water flow path 24 through the spray body 22 is comprised of the vortex chamber at the inlet end, an intermediate linearly diverging nozzle portion 70 and a bulbous terminal portion 72 which defines the spray outlet 28. The vortex chamber is generally cylindrical in shape. Radial flange 76 forms the bottom wall of the chamber and annular wall 78 forms the side wall of the chamber. The top of the chamber is closed by plastic disc or cap 80. As noted earlier, a plurality of tangential passageways 34 (FIG. 4) are provided in the annular wall 78 to direct water flowing into the vortex chamber in a swirling, vortex creating action. Water exits from the vortex chamber through center end outlet 36.

The vortex chamber serves to limit the flow of water through the shower head to a preferred or selected range under typical residential water pressure conditions. As noted earlier, the reasons why the shower head limits the flow as it does are not fully understood. It is presently believed that the centrifugal, swirling action of the water creates a back pressure at the tangential passageways 34, restricting the amount of water flowing into the vortex chamber. One particular advantage of the vortex flow regulator is that, in a sense, it is "self-adjusting" to different water pressure conditions. For example, if the shower head is used in an area having relatively high water pressure, the high pressure is believed to result in greater vortex action and a resultant higher pressure, which serves to counter the higher supply pressure, and restricts the flow to the desired range. The flow rate or range selected is a matter of design choice and is dependent primarily on the size of the tangential passageways 34 and the outlet orifice 36.

Water exits from vortex chamber outlet 36, into the nozzle 70. The nozzle 70 increases in diameter substantially linearly, providing a modified venturi effect, which slows the speed of the exiting water, increases the pressure, and, importantly, creates a uniform highly diffuse solid spray of water. Without the nozzle 70, water exiting from the vortex chamber would likely form a hollow ring of spray which is considered undesirable for domestic use.

The nozzle 70 linearly diverges at two different angles. The upstream portion of the nozzle, between aperture 36 and point X, diverges at a selected angle A, of about degrees in the preferred embodiment. The downstream portion of the nozzle, between point X and the end of the nozzle, diverges at selected angle B, which is greater than angle A, and is about degrees in the preferred embodiment. The diverging angles create a uniform, highly diffuse spray, particularly suited for domestic use.

The nozzle 70 discharges into the terminal portion 72, which has a curved wall forming a primarily decorative bulbous or bowl-shaped end of the spray body.

The spray body 20 is held in a pivoting relationship to the concave surface 18, by outer sleeve 22. The sleeve 22 may be made of plastic or other corrosion resistant material. Preferably the material should also be suitable for chrome plating or the like to provide a decorative appearance. The sleeve is slightly tapered so that the smaller diameter end engages behind the curved wall 38 of the fixed member 12. The large diameter end of the sleeve is internally threaded to engage threads 82 on the exterior surface of the bulbous end 72 of the spray body. With this construction, the spray body is easily assembled to the fixed member by threaded insertion into the sleeve until O-ring 30 is compressed against concave surface 18.

In the preferred embodiment, the O-ring 30 is disposed around the annular wall 78 of the vortex chamber and against radial flange 76. When the spray body is threaded into the sleeve, the radial flange presses the O-ring tightly against the concave surface 18 of spray body, causing the O-ring to seal against the concave surface along a circular line which encloses the water supply aperture 28 regardless of the pivot position of the spray body. Thus, the O-ring prevents any leakage into the area between the spray body and the sleeve while permitting the vortex chamber inlets 34 to remain in continuous fluid communication with the aperture 28. Although the O-ring engages the concave surface sufficiently tightly to provide a liquid-tight seal, it remains slidable over the curved surface to permit pivoting of the spray head with respect to the first member 12. In the event of any wear of the O-ring, which will be reflected in a freer pivoting of the spray head, further tightening of the spray body within the outer sleeve causes the O-ring to press more tightly against the concave surface 18 and compensates for the wear.

The particular O-ring mounting of the present invention has an additional advantage. A substantial portion of its surface area of the O-ring faces upstream and is open to contact by high pressure upstream water. When the shower head is turned on, water pressure tends to push the O-ring outwardly, causing it to press more tightly against the concave surface 18, and resulting in even a better seal thereagainst when the shower head is being used.

Although the present invention has been described in terms of the preferred embodiment, the scope of this invention, as set forth in the appended claims, is intended to include those equivalent structures, some of which may be immediately apparent from review of this description and other of which may be apparent only after some study.

What is claimed is:

1. In a shower head comprising a first portion adapted to be attached to a water supply and a spray head pivotally attached to said first portion, the improvement comprising, in combination; said first portion including a shallow, curved, socket-defining shell, an aperture in said shell and a flow path for communicating between the water supply and the aperture;

said spray head comprising an inner spray body and a separable outer sleeve, said spray body having a flow limiting vortex chamber with water inlet opening means at one end of said spray body, a spray outlet at the other end and a diverging flow path portion therebetween, one end of said sleeve slidably engaged behind said shell and the other end being threadably engaged with said spray body at said other end to pivotally secure said spray body to the inside surface of said shell; and a resilient O-ring carried by said spray body at said one end and disposed around said vortex chamber to slidably and sealingly engage the inside surface of said shell along an uninterrupted line enclosing said aperture at all pivot positions of said spray head to prevent leakage between said spray body and said concave surface while allowing communication between said aperture and said water inlet opening means of said vortex chamber.

2. A shower head comprising:

a first member adapted for attachment to a water supply, said first member including a concave, socketdefining surface, an aperture in said surface and a fluid passageway for communicating between said aperture and the water supply;

a spray head pivotally mounted on said first member, said spray head including an inner spray body and an outer sleeve, said inner spray body having a water inlet at one end, a spray outlet at the other end and a flow path therebetween, said outer sleeve securing said spray body to said first member with said one end of said spray body pivotally received within said concave, socketdefining surface and said water inlet in communication with the aperture in said first member;

annular sealing means carried on said one end of said inner spray body around said water inlet and slidably engaging the concave surface of said first member along a line enclosing said aperture at all pivot positions of said spray head so as to permit pivoting of said spray head with said water inlet in continuous communication with said aperture, while preventing leakage between said spray body and said concave surface;

spray generating means disposed in said flow path and including means to direct water flowing through said flow path in a swirling, vortex generating direction; and said flow path comprising an outwardly tapered nozzle portion downstream of said spray generating means to form the spray into a substantially full pattern.

3. A shower head in accordance with claim 2 further comprising a vortex chamber defined at said water inlet end of said flow path, and including tangential passageways to direct water flowing from said aperture into said vortex chamber in a swirling direction.

4. A shower head in accordance with claim 2 wherein said annular sealing means comprises a resilient O-ring.

5. A shower head in accordance with claim 4 wherein a substantial portion of the surface of said O-ring is exposed to upstream water pressure, whereby the water pressure aids in compressing the O-ring seal into intimate sealing contact with said concave surface.

6. A shower head in accordance with claim 2 wherein said concave surface is defined by a spherical wall portion and said sleeve slidably engages the outer surface of said spherical wall portion to permit pivoting of said spray head with respect to said concave surface.

7. A shower head in accordance with claim 3 wherein said annular sealing means comprises an O-ring disposed around said vortex chamber.

8. A shower head in accordance with claim 7 wherein a substantial portion of the surface of said O-ring is exposed to upstream water pressure to aid in forcing the O-ring into intimate sealing contact with said concave surface.

9. A shower head in accordance with claim 2 wherein said body portion terminates at said other end in a relatively large, curved discharge nozzle, downstream of said outwardly tapered nozzle.

10. A shower head in accordance with claim 2 wherein said fluid path in said spray body comprises a vortex chamber at said one end, including tangential passageways to direct water entering said chamber in a swirling direction, an outlet opening in the center of said vortex chamber and a linearly diverging nozzle portion downstream of said outlet opening.

11. A shower head in accordance with claim 2 further comprising a water control valve in said fluid passageway of said first member upstream of said aperture in said concave surface.

12. A shower head in accordance with claim 2 wherein said nozzle portion linearly diverges at at least two different angles, the downstream-most angle of said two different angles being greater than the upstream-most of said two different angles.

13. A shower head in accordance with claim 2 wherein said spray body has an annular wall defining a vortex chamber at said one end of said flow path, and a radially extending flange adjacent said annular wall, a resilient O-ring being disposed around said annular wall and against said radial flange to slidably and sealably engage against said concave surface.

* * * * *